US011738971B2

(12) United States Patent
Hollowell

(10) Patent No.: US 11,738,971 B2
(45) Date of Patent: Aug. 29, 2023

(54) ELEVATOR GOVERNOR TENSION FRAME DAMPER

(71) Applicant: OTIS ELEVATOR COMPANY, Farmington, CT (US)

(72) Inventor: Richard L. Hollowell, West Hartford, CT (US)

(73) Assignee: OTIS ELEVATOR COMPANY, Farmington, CT (US)

( * ) Notice: Subject to any disclaimer, the term of this patent is extended or adjusted under 35 U.S.C. 154(b) by 0 days.

(21) Appl. No.: 17/358,425

(22) Filed: Jun. 25, 2021

(65) Prior Publication Data

US 2022/0411228 A1 Dec. 29, 2022

(51) Int. Cl.

| | |
|---|---|
| ***B66B 5/04*** | (2006.01) |
| ***B66B 1/26*** | (2006.01) |
| ***B66B 5/16*** | (2006.01) |

(52) U.S. Cl.

CPC ..... *B66B 5/044* (2013.01); *B66B 1/26* (2013.01); *B66B 5/16* (2013.01)

(58) Field of Classification Search

CPC ..... B66B 5/044; B66B 5/16; B66B 1/26
See application file for complete search history.

(56) References Cited

U.S. PATENT DOCUMENTS

| | | | |
|---|---|---|---|
| 4,565,264 | A | 1/1986 | Kunii |
| 6,619,435 | B1 | 9/2003 | Walzke et al. |
| 8,869,946 | B2 | 10/2014 | Okada |
| 9,272,881 | B2 | 3/2016 | Zhu et al. |
| 9,475,674 | B2 | 10/2016 | Benosman et al. |
| 9,902,593 | B2 | 2/2018 | Barneman et al. |
| 10,093,515 | B2 | 10/2018 | Shiraishi et al. |
| 10,654,685 | B2 | 5/2020 | Fauconnet |
| 2014/0083802 | A1 | 3/2014 | Aulanko et al. |
| 2015/0353323 | A1 | 12/2015 | Shiraishi et al. |
| 2018/0297814 | A1 | 10/2018 | Shiraishi et al. |

FOREIGN PATENT DOCUMENTS

| | | | |
|---|---|---|---|
| CN | 101100259 | B | 9/2010 |
| CN | 102633174 | B | 5/2015 |
| CN | 105384028 | B | 8/2017 |
| CN | 109562910 | B | 3/2021 |
| EP | 0917518 | B1 | 5/2000 |
| EP | 1900673 | A1 | 3/2008 |

(Continued)

OTHER PUBLICATIONS

English Machine Translation of JP 2016-003137.*
Extended European Search Report for Application No. EP 21 21 0601.7 dated May 16, 2022.

*Primary Examiner* — Diem M Tran
(74) *Attorney, Agent, or Firm* — Carlson, Gaskey & Olds, P.C.

(57) ABSTRACT

An illustrative example embodiment of an elevator governor includes a rotatable governor mechanism, a tension sheave, and a tension frame associated with the tension sheave. The tension frame has a mass configured to bias the tension frame and the tension sheave under an influence of gravity. A damper is configured to resist vertical movement of the tension frame relative to a fixed surface in a first condition and to allow vertical movement of the tension frame relative to the fixed surface in a second, different condition.

10 Claims, 2 Drawing Sheets

(56) References Cited

FOREIGN PATENT DOCUMENTS

| | | | | | |
|---|---|---|---|---|---|
| EP | 2636628 | A1 | | 9/2013 | |
| EP | 1789357 | B1 | | 9/2015 | |
| EP | 2487128 | B1 | | 3/2017 | |
| EP | 3153449 | B1 | | 3/2019 | |
| EP | 1870368 | B1 | | 4/2019 | |
| JP | S59128182 | A | | 7/1984 | |
| JP | H05319724 | A | | 12/1993 | |
| JP | H10167607 | A | | 6/1998 | |
| JP | H1171069 | A | | 3/1999 | |
| JP | 2008013309 | A | | 1/2008 | |
| JP | 2008230779 | A | * | 10/2008 | |
| JP | 2014177333 | A | * | 9/2014 | |
| JP | 2016003137 | A | * | 1/2016 | |
| JP | 6222570 | B2 | | 11/2017 | |
| KR | 100257356 | B1 | | 5/2000 | |
| KR | 20050021608 | A | | 3/2005 | |
| KR | 101647788 | B1 | | 8/2016 | |
| WO | 2011037557 | A1 | | 3/2011 | |
| WO | WO-2015155854 | A1 | * | 10/2015 | ..... B66B 5/0031 |

* cited by examiner

ELEVATOR GOVERNOR TENSION FRAME DAMPER

BACKGROUND

Elevator systems include a variety of control features to maintain desired motion of the elevator car. Governors are typically included to monitor the speed of the car. The governor provides feedback information regarding the speed of the car. Another function of the governor is to activate a safety brake system if an overspeed condition occurs to bring the car to a stop.

Typical governor configurations include a rotating governor mechanism near the top of the hoistway. A governor rope wraps over the rotating governor mechanism and extends down to a governor tension sheave. A weight associated with the tension sheave maintains tension on the governor rope.

The governor rope moves as the elevator car moves and a speed of rotation of the governor mechanism corresponds to the speed of car movement. In high rise buildings it is possible for the governor to have a low frequency response when the elevator car completes a run at certain floors, such as the lower floors in the building. In the event that the governor low frequency response coincides with a frequency response of the elevator car, which may be due to the extended length of the roping suspending the elevator car, any position feedback information provided by the governor may be inaccurate.

SUMMARY

An illustrative example embodiment of an elevator governor includes a rotatable governor mechanism, a tension sheave, and a tension frame associated with the tension sheave. The tension frame has a mass configured to bias the tension frame and the tension sheave under an influence of gravity. A damper is configured to resist vertical movement of the tension frame relative to a fixed surface in a first condition and to allow vertical movement of the tension frame relative to the fixed surface in a second, different condition.

In addition to one or more of the features described above, or as an alternative, the first condition includes a first speed of movement of the tension frame above a threshold speed or a first frequency of movement of the tension frame above a threshold frequency, and the second condition includes a second speed of movement of the tension frame below the threshold speed or a second frequency of movement of the tension frame below the threshold frequency.

In addition to one or more of the features described above, or as an alternative, the damper has a damping force that resists the vertical movement of the tension frame, and the damping force changes with a change in a speed of vertical movement of the tension frame.

In addition to one or more of the features described above, or as an alternative, the first condition comprises a time during movement of an associated elevator car or within a selected range after completion of movement of the associated elevator car, and the second condition comprises a time while the associated elevator car is stationary and outside the selected range.

In addition to one or more of the features described above, or as an alternative, the damper comprises a base and a mounting frame, the mounting frame is configured to be secured to the fixed surface, the mounting frame is configured to resist vertical movement of the base, and the mounting frame is configured to allow for at least some lateral movement of the base relative to the mounting frame.

In addition to one or more of the features described above, or as an alternative, wherein the mounting frame is configured to be secured to at least one of a floor surface and a wall surface in a hoistway.

In addition to one or more of the features described above, or as an alternative, the damper includes a coupling configured to secure at least one portion of the damper to the tension frame, and the coupling allows for at least some lateral movement of the tension frame relative to the damper.

In addition to one or more of the features described above, or as an alternative, an elevator system, includes the elevator governor of any of the previous paragraphs, an elevator car; and a governor rope coupled with the elevator car, the governor rope wrapping at least partially around the governor mechanism and the tension sheave, wherein movement of the elevator car causes movement of the governor rope and rotational movement of the governor mechanism.

In addition to one or more of the features described above, or as an alternative, the elevator system of the previous paragraph includes a device that determines elevator car movement and wherein the governor provides an additional indication of the elevator car movement.

The various features and advantages of at least one disclosed example embodiment will become apparent to those skilled in the art from the following detailed description. The drawings that accompany the detailed description can be briefly described as follows.

DETAILED DESCRIPTION

Figure 1:
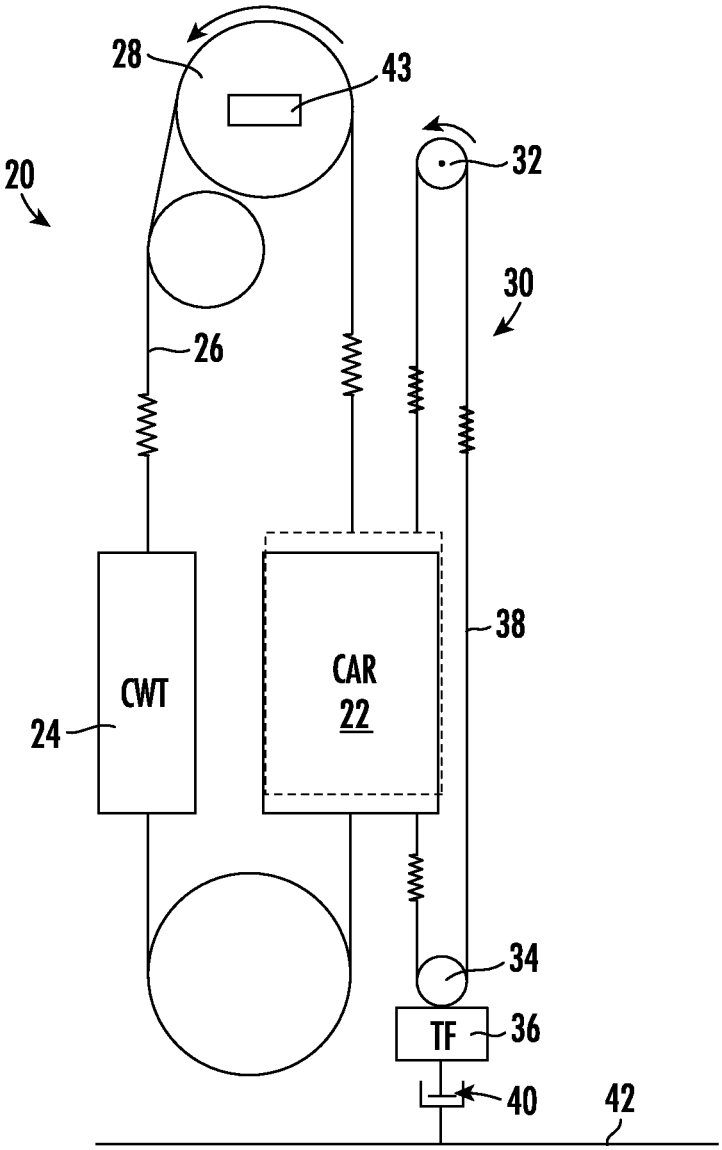
FIG. 1 schematically illustrates selected portions of an example embodiment of an elevator system including a governor tension frame damper.

FIG. 1 schematically illustrates selected portions of an elevator system 20. An elevator car 22 is coupled to a counterweight 24 by a plurality of tension members 26 that suspend the elevator car 22 and counterweight 24. In some embodiments, the tension members 26 are round steel ropes. Other embodiments include ropes made of different materials. Still other embodiments include belts as the tension members 26. A traction sheave 28 of an elevator machine rotates to cause movement of the tension members 26, which results in desired movement of the elevator car 22.

A governor 30 includes a governor mechanism 32 and a tension sheave 34. A tension frame 36 is coupled with the tension sheave 34. The tension frame 36 has a mass that biases the tension sheave 34 and the tension frame 36 under the influence of gravity. A governor rope 38 is coupled to the elevator car 22 and arranged in a loop that partially wraps around the governor mechanism 32 near a top of the loop and the tension sheave 34 near a bottom of the loop.

As the elevator car 22 moves vertically, the governor rope 38 moves and the governor mechanism 32 responsively rotates. The governor mechanism 32 is operative to engage a safety brake (not illustrated) in a well-known manner if an overspeed condition exists.

In a high-rise building, the length of the tension members 26 tends to allow for some resonance of the elevator system 20 that can result in oscillations of the elevator car 22 when arriving at a destination floor as schematically represented by the broken lines 22'. Building sway may also contribute to such oscillations. It is possible for such oscillations to cause corresponding movement of the tension sheave 34 and tension frame 36. The example governor 30 includes a damper 40 that is configured to resist vertical movement of the tension frame 36 relative to a stationary surface 42, such as a floor or a wall of a hoistway or pit. The damper 40 is configured to resist vertical movement of the tension frame 36, and the associated tension sheave 34, under a first condition and to allow for vertical movement of the tension frame 36 and the tension sheave 34 under a second, different condition.

An example first condition includes oscillations of the elevator car 22, such as at a resonant frequency of the tension members 26. It is undesirable for the tension frame 36 to oscillate vertically in response to oscillations of the elevator car 22. The damper 40 is configured to resist vertical movement of the tension frame 36 under such a first condition.

It is desirable, however, to allow the tension frame 36 to move downward slowly over time as the governor rope 38 stretches, for example. An example second condition in which the damper 40 allows such vertical movement of the tension frame 36 includes the elevator car 22 remaining stationary.

The damper 40 in the example embodiment is configured to provide or impose a damping force that resists vertical movement of the tension frame 36 relative to the stationary surface 42. The damping force changes with changes in a speed of vertical movement of the tension frame 36. In some embodiments, the damping force is proportional to a speed with which the tension frame 36 tends to move vertically. There are known hydraulic dampers that have such a changing and responsive damping force and some embodiments include such a known damper. Such a changing or responsive damping force allows for slow, downward movement of the tension frame 36 over time but resists rapid vertical movement of the tension frame 36 during or immediately after a run of the elevator car 22 to a destination landing.

The first and second conditions may be defined differently in different embodiments. For example, the first and second condition are defined based on a speed or frequency of movement of the tension frame 36. In some such embodiments, the first condition includes a first speed of movement of the tension frame 36 or a first frequency of movement of the tension frame 36 above a threshold. The second condition in such embodiments includes a second speed or frequency of movement of the tension frame 36 below the threshold.

The first condition in some embodiments is defined based on a time during movement of the elevator car 22 or within a selected range after completion of movement of the elevator car 22 arriving at a destination landing. Including some time within the selected range after the arrival of the elevator car 22 at the destination accounts for oscillations that may occur after such arrival. The, second condition is defined based on a time while the associated elevator car is stationary. The second condition does not include time within the selected range of time included in the first condition.

One aspect of resisting vertical movement of the tension frame 36 is maintaining the accuracy or reliability of information provided by the governor mechanism 32 to a device 43 that monitors or determines elevator car position or movement. The device may be, for example, a portion of the machine or drive used to control movement of the elevator car 22. When the elevator car 22 oscillates and the tension frame 36 experiences corresponding oscillation, such movement of the tension frame 36 tends to be at a lower frequency than that of the elevator car 22. That difference tends to introduce inconsistencies or errors into the position or movement information provided by the governor mechanism 32 to the device 43. Resisting vertical movement of the tension frame 36 using the damper 40 reduces or eliminates such inconsistencies or errors.

Figure 2:
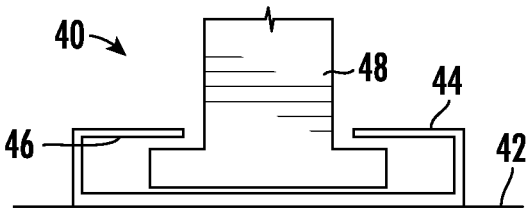
FIG. 2 schematically illustrates selected portions of an example damper configuration.

The damper 40 is also configured to allow for some lateral or side-to-side movement of the tension frame 36. FIG. 2 schematically illustrates an example arrangement including a mounting frame 44 that is configured to be secured to the surface 42, such as the floor of the hoistway or pit. The mounting frame 44 includes a recess or cavity 46 that accommodates a portion of a base 48 of the damper 40. The relative sizes of the recess or cavity 46 and the accommodated portion of the base 48 allow for some lateral movement of the damper 40 while holding the damper 40 in a manner that facilitates the damper 40 selectively resisting vertical movement of the tension frame 36.

Figure 3:
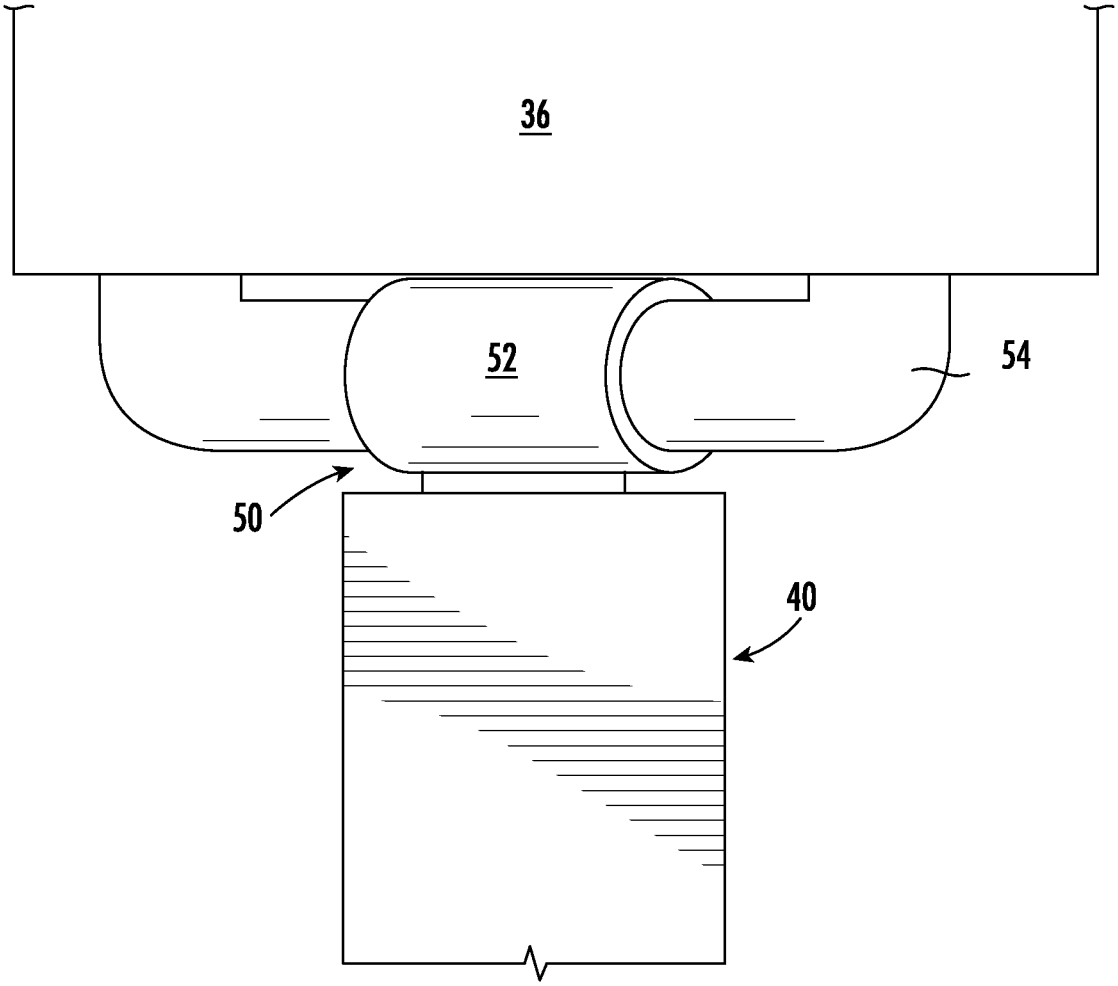
FIG. 3 schematically illustrates selected portions of another example damper configuration.

Another configuration is shown in FIG. 3. In this example embodiment, the damper 40 includes a coupling 50 that secures the damper 40 to the tension frame 36. The coupling 50 includes a bushing 52 that allows for relative lateral sliding between a bracket or rod 54 secured to the tension frame 36 and the damper 40.

The disclosed example embodiments provide damping to resist undesirable vertical movement of a governor tension frame 36 and tension sheave 34, which avoids undesirable movement of the governor mechanism 32. Reducing or eliminating such undesirable movement provides more reliable or accurate position or movement information from the governor 30, which can be used for monitoring and controlling elevator car movement.

The preceding description is exemplary rather than limiting in nature. Variations and modifications to the disclosed examples may become apparent to those skilled in the art that do not necessarily depart from the essence of this invention. The scope of legal protection given to this invention can only be determined by studying the following claims.

I claim:

1. An elevator governor, comprising:

a rotatable governor mechanism;

a tension sheave;

a tension frame associated with the tension sheave, the tension frame having a mass configured to bias the tension frame and the tension sheave under an influence of gravity; and a damper configured to resist vertical movement of the tension frame relative to a fixed surface in a first condition, the damper being configured to allow vertical movement of the tension frame relative to the fixed surface in a second, different condition, wherein the damper includes a coupling configured to secure at least one portion of the damper to the tension frame, and the coupling allows for at least some lateral movement of the tension frame relative to the damper.

2. The elevator governor of claim 1, wherein the first condition includes a first speed of movement of the tension frame above a threshold speed or a first frequency of movement of the tension frame above a threshold frequency, and the second condition includes a second speed of movement of the tension frame below the threshold speed or a second frequency of movement of the tension frame below the threshold frequency.

3. The elevator governor of claim 1, wherein the damper has a damping force that resists the vertical movement of the tension frame, and the damping force changes with a change in a speed of vertical movement of the tension frame.

4. The elevator governor of claim 1, wherein the first condition comprises a time during movement of an associated elevator car or within a selected range after completion of movement of the associated elevator car, and the second condition comprises a time while the associated elevator car is stationary and outside the selected range.

5. The elevator governor of claim 1, wherein the damper comprises a base and a mounting frame, the mounting frame is configured to be secured to the fixed surface, the mounting frame is configured to resist vertical movement of the base, and the mounting frame is configured to allow for at least some lateral movement of the base relative to the mounting frame.

6. The elevator governor of claim 5, wherein the mounting frame is configured to be secured to at least one of a floor surface and a wall surface in a hoistway.

7. An elevator system, comprising the elevator governor of claim 1, an elevator car; and a governor rope coupled with the elevator car, the governor rope wrapping at least partially around the governor mechanism and the tension sheave, wherein movement of the elevator car causes movement of the governor rope and rotational movement of the governor mechanism.

8. The elevator system of claim 7, comprising a device that determines elevator car movement and wherein the governor provides an additional indication of the elevator car movement.

9. An elevator governor, comprising:

a rotatable governor mechanism;

a tension sheave;

a tension frame associated with the tension sheave, the tension frame having a mass configured to bias the tension frame and the tension sheave under an influence of gravity; and a damper configured to resist vertical movement of the tension frame relative to a fixed surface in a first condition, the damper being configured to allow vertical movement of the tension frame relative to the fixed surface in a second, different condition, wherein the damper comprises a base and a mounting frame, the mounting frame is configured to be secured to the fixed surface, the mounting frame is configured to resist vertical movement of the base, and the mounting frame is configured to allow for at least some lateral movement of the base relative to the mounting frame.

10. The elevator governor of claim 9, wherein the mounting frame is configured to be secured to at least one of a floor surface and a wall surface in a hoistway.

* * * * *